US005332360A

United States Patent [19]

Correia et al.

[11] Patent Number: 5,332,360

[45] Date of Patent: Jul. 26, 1994

[54] STATOR VANE HAVING REINFORCED BRAZE JOINT

[75] Inventors: Victor H. S. Correia, Scotia, N.Y.; Kevin G. McAllister, West Chester, Ohio

[73] Assignee: General Electric Company, Cincinnati, Ohio

[21] Appl. No.: 117,853

[22] Filed: Sep. 8, 1993

[51] Int. Cl.[5] ..... F01D 9/02

[52] U.S. Cl. ..... 415/209.3; 29/889.21

[58] Field of Search ..... 415/209.1, 209.2, 209.3; 416/189, 191; 29/889.1, 889.21, 889.71

[56] References Cited

U.S. PATENT DOCUMENTS 4,889,470 12/1989 Scalzo ..... 415/209.2
5,226,789 7/1993 Donges ..... 415/209.2
5,248,240 9/1993 Correia ..... 415/209.1
5,269,057 12/1993 Mendham ..... 29/889.1

FOREIGN PATENT DOCUMENTS 2407960 10/1974 Fed. Rep. of Germany ... 415/209.3
732920 6/1955 United Kingdom ..... 415/209.3

*Primary Examiner*—Edward K. Look
*Assistant Examiner*—Michael S. Lee
*Attorney, Agent, or Firm*—Jerome C. Squillaro; Nathan D. Herkamp

[57] ABSTRACT

A gas turbine engine stator vane includes a groove extending laterally in an outer surface at one end thereof between leading and trailing edges for receiving a brazing material. The vane may be joined to an arcuate band having a complementary groove extending colinearly with the airfoil groove to collectively define therebetween an enlarged crevice for receiving the brazing material to form a reinforcing pin therein.

11 Claims, 6 Drawing Sheets

STATOR VANE HAVING REINFORCED BRAZE JOINT

The present invention relates generally to gas turbine engines, and, more specifically, to turbine nozzles therein.

BACKGROUND OF THE INVENTION

In a gas turbine engine, a combustor discharges hot combustion gases downstream through a high pressure (HP) stationary or stator turbine nozzle which directs the flow between rotor blades of a high pressure turbine (HPT) for extracting energy therefrom. The HPT may have a second stage of rotor blades disposed downstream from the first stage with an additional, second stage turbine nozzle disposed therebetween for channeling the combustion gases from the first stage rotor blades to the second stage rotor blades.

The HP first stage turbine nozzle and the second stage turbine nozzle each include a plurality of circumferentially spaced apart stator vanes or airfoils joined at their radially outer and inner ends to annular outer bands. The nozzles are typically made in arcuate segments with arcuate outer and inner band segments each having one or more vanes per segment. The segments are conventionally joined together to collectively form a complete 360° turbine nozzle.

The HP stage one nozzle is typically supported in the engine at both its outer and inner bands for accommodating loads thereon including pressure forces from the combustion gases channeled between the vanes. However, the second stage nozzle is supported solely at its outer band since a conventional annular seal member is disposed between the first and second rotor stages preventing stationary support of the inner band as well. Accordingly, the vanes of the second stage nozzle are cantilevered from the outer band support which creates bending moments due to the combustion gases flowing between the vanes which must be suitably reacted or accommodated through the outer band.

Since the HP stage one nozzle is supported at both its inner and outer bands, it may be relatively simply manufactured by brazing the vanes at their outer and inner ends to the respective outer and inner bands. However, braze joints have acceptable shear strength but undesirable bending strength. Since the HP nozzle is supported at its outer and inner bands, bending moments from the combustion gases are insignificant, whereas the bending moments in the second stage nozzle are significant since it is supported solely at its outer band, with the inner band thereof being unsupported.

Accordingly, brazed turbine nozzles are typically not used where they cannot be supported at both their outer and inner bands which, therefore, requires alternate and typically more complex and expensive designs.

For example, the vanes may be integrally cast in groups to their outer and inner bands to form integral nozzle segments which do not require brazing between the vanes and bands. Alternatively, a single vane may be integrally cast to outer and inner band segments to avoid brazing therebetween, with the band segments themselves being brazed together at the circumferential joints therebetween. However, these methods of manufacture are not suitable for conventional, high strength, single crystal vanes which are desirable for use in second stage turbine nozzles of improved gas turbine engines.

Accordingly, a simpler and less expensive brazed turbine nozzle is desired for those stages wherein the nozzle is supported solely by its outer band, and which allows the use of single crystal vanes.

SUMMARY OF THE INVENTION

A gas turbine engine stator vane includes a groove extending laterally in an outer surface at one end thereof between leading and trailing edges for receiving a brazing material. The vane may be joined to an arcuate band having a complementary groove extending colinearly with the airfoil groove to collectively define therebetween an enlarged crevice for receiving the brazing material to form a reinforcing pin therein.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
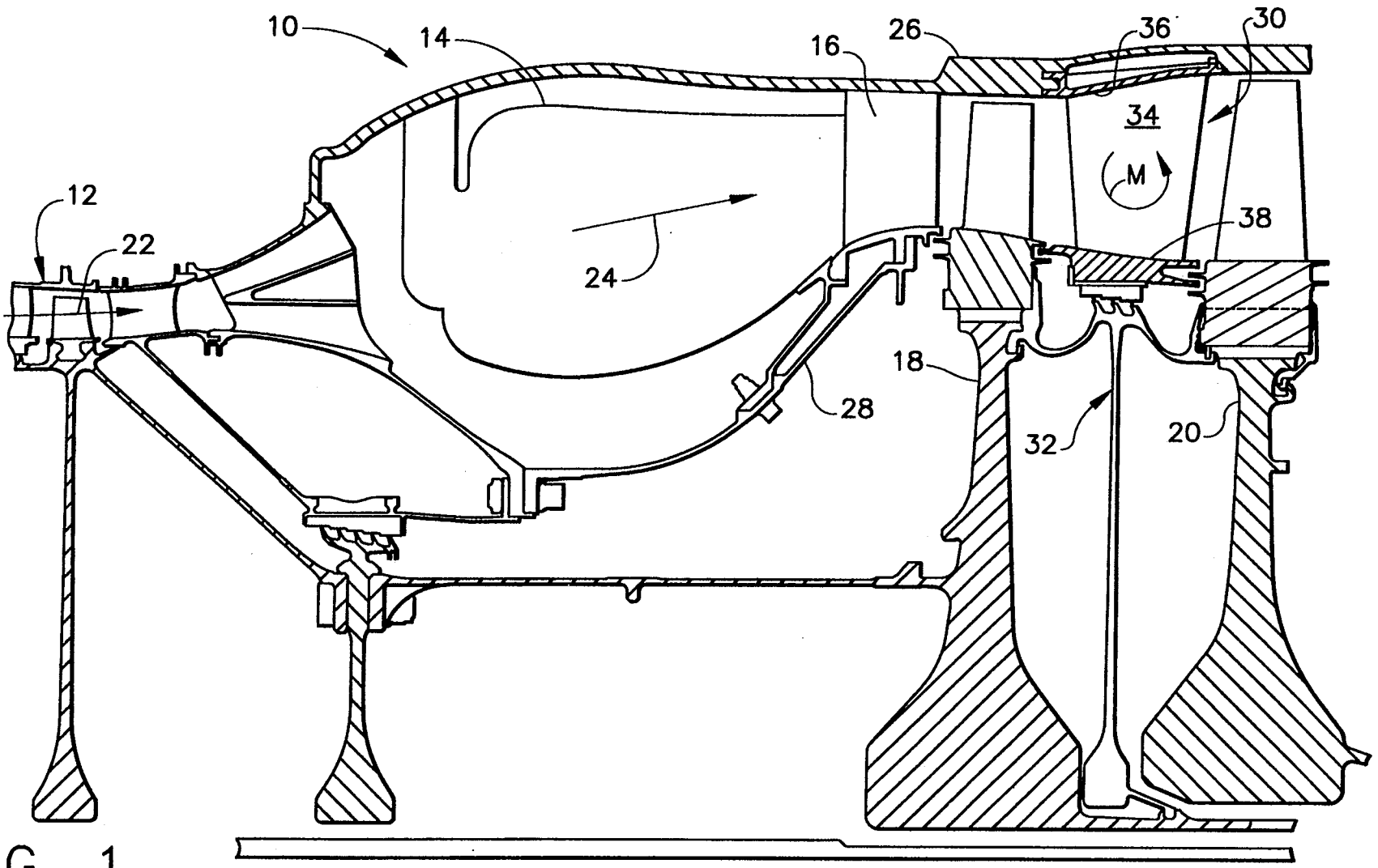
FIG. 1 is an axial, partly sectional view of a portion of an exemplary gas turbine engine having a two-stage high pressure turbine with a turbine nozzle disposed therebetween in accordance with one embodiment of the present invention.

Illustrated schematically in FIG. 1 is a portion of an exemplary aircraft gas turbine engine 10 having in serial flow communication about a longitudinal or axial centerline axis a conventional axial, high pressure compressor (HPC) 12, combustor 14, high pressure (HP) turbine nozzle 16 (stage one), a high pressure turbine (HPT)

stage one rotor 18, and an HPT stage two rotor 20 disposed downstream therefrom. During operation, the HPC 12 provides compressed air 22 to the combustor 14 wherein it is conventionally mixed with fuel and ignited to generate hot combustion gas 24. The combustion gas 24 is channeled through the HP nozzle 16 and through the rotor blades of the first stage rotor 18 which extract energy therefrom for driving the HPC 12. The combustion gas 24 also flows between the rotor blades of the second stage rotor 20 which extract additional energy therefrom.

The HP nozzle 16 is conventional and includes a plurality of circumferentially spaced apart vanes joined between outer and inner bands which are separately supported by a conventional annular outer casing 26 and an annular inner support 28, respectively.

In accordance with one embodiment of the present invention a second stage stationary or stator HPT turbine nozzle 30 is disposed between the first and second stage rotors 18, 20. The nozzle 30 is supported solely to the outer casing 26 since a conventional annular rotor seal member 32 is disposed radially below the nozzle 30 and axially between the first and second stage rotors 18, 20.

Figure 2:
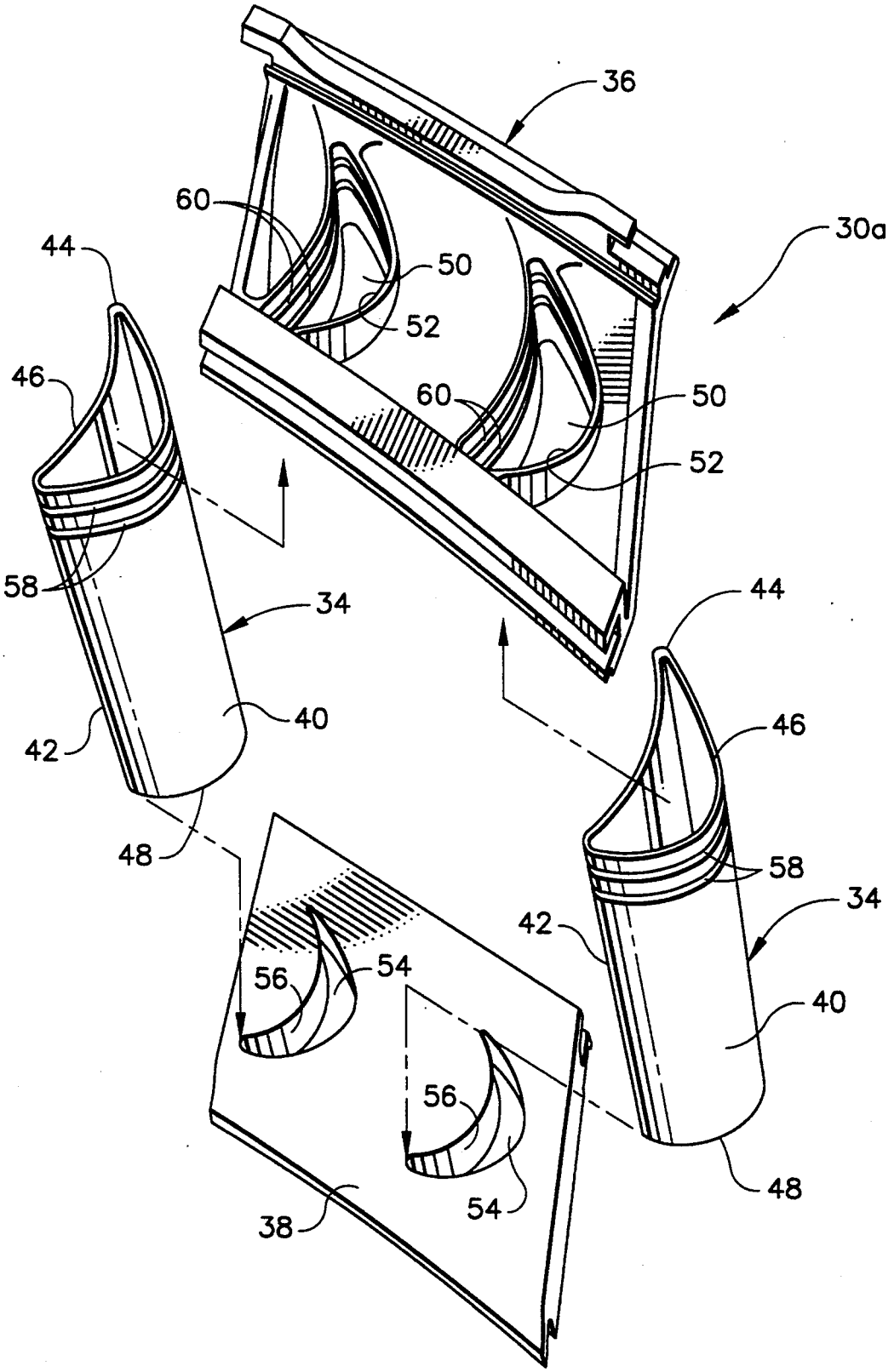
FIG. 2 is an exploded view of an exemplary segment of the second stage turbine nozzle illustrated in FIG. 1 in accordance with one embodiment of the present invention.
Figure 3:
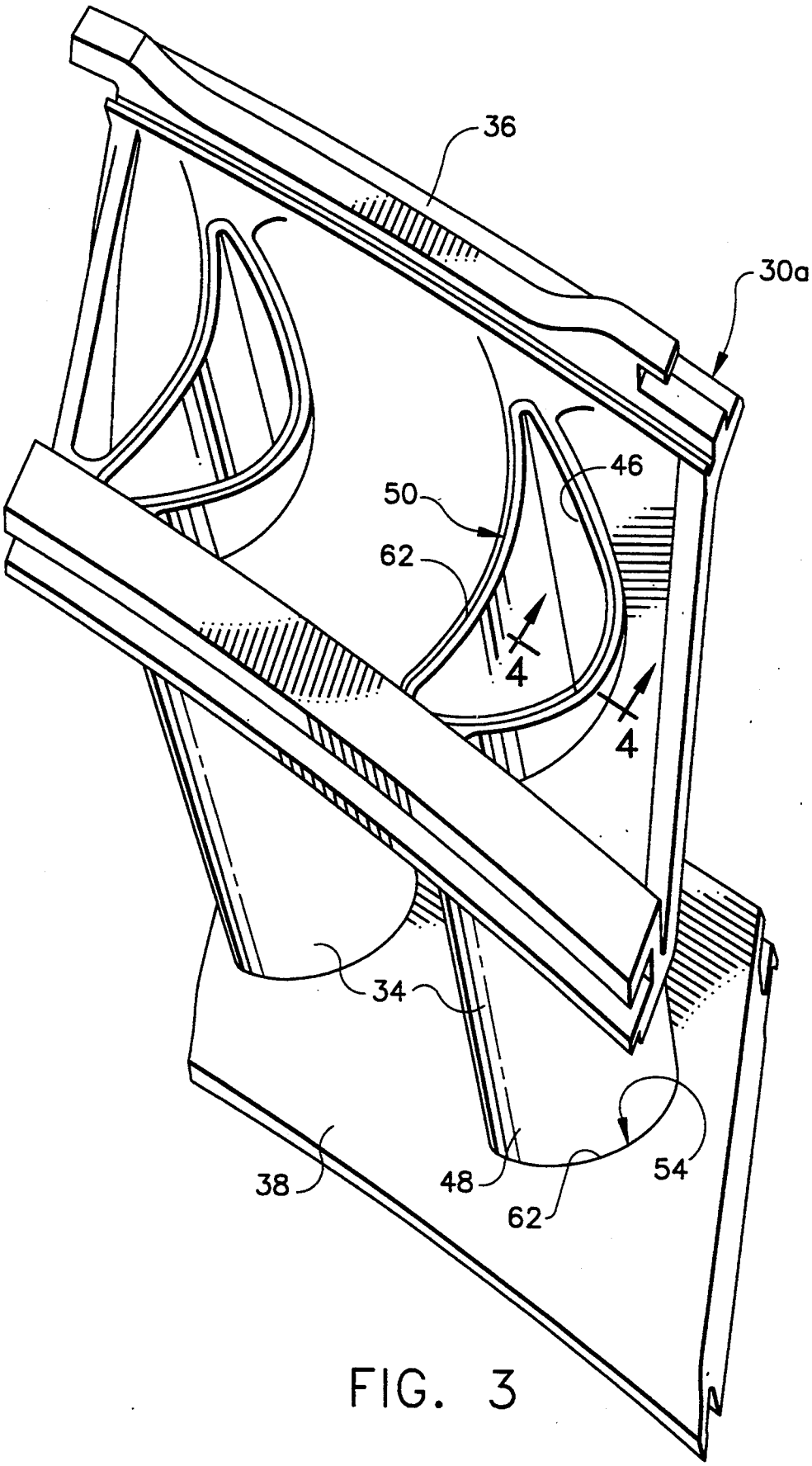
FIG. 3 is a perspective view of the nozzle segment illustrated in FIG. 2 in assembled form.

More specifically, the nozzle 30 includes a plurality of circumferentially spaced apart stator vanes 34 as shown in FIGS. 1–3 which are joined to a radially outer or first band 36 and to a radially inner or second band 38. As shown in FIGS. 2 and 3, the nozzle 30 preferably includes a plurality of conventionally joined, circumferentially spaced apart, arcuate nozzle segments **30*a* having two vanes 34 per segment, for example, fixedly joined to respective arcuate portions of the outer and inner bands 36, 38 in accordance with the present invention. Although two vanes 34 per segment 30*a* are shown, one vane 34 per segment 30*a* or more than two vanes per segment 30*a*** may be used as desired.

As shown in FIG. 2, each stator vane 34 is in the form of a hollow airfoil having an outer surface 40 extending laterally between a radially extending leading edge 42 and a radially extending trailing edge 44. The leading and trailing edges 42, 44 extend radially, or longitudinally relative to the vane 34, between a first or radially outer end 46 and an opposite second or radially inner end 48. The general configuration of the vane 34 is conventional with the outer surface 40 thereof defining an outwardly convex side and an opposite outwardly concave side extending laterally or axially between the leading and trailing edges 42, 44.

The outer band 36 includes one or more first support apertures 50 defined by a radially extending inner surface 52 which is complementary in configuration with the vane 34 at the first end 46 thereof for receiving therein the first end 46. Similarly, the inner band 38 includes one or more second support apertures 54 defined by a radially extending inner surface 56 which is complementary in configuration with the vane 34 at the second end 48 thereof for receiving therein the second end 48.

In accordance with one embodiment of the present invention, the vane outer surface 40 adjacent the first end 46 includes at least one U-shaped groove or slot 58 therein extending at least in part laterally between the leading and trailing edges 42, 44, and in the preferred embodiment illustrated in FIG. 2, the groove 58 extends completely around the vane 34 along both sides thereof between the leading and trailing edged 42, 44. Similarly, the support aperture inner surface 52 includes at least one U-shaped groove or slot 60 positioned therein for extending colinearly with and facing the respective airfoil grooves 58 upon assembly. The band grooves 60 similarly extend completely around the inner surface 52 of the support aperture 50 in the preferred embodiment. As shown in FIG. 2, each of the vanes 34 has its first end 46 inserted into its respective support aperture 50, with the second end 48 thereof being inserted into its respective support aperture 54 in the inner band 38 to form the four-piece assembly illustrated in FIG. 3.

The vanes 34 are conventionally fixtured to the outer and inner bands 36, 38 so that they may be conventionally brazed together using a conventional brazing material 62 in both the outer and inner bands 36, 38. The brazing material 62 is suitably melted and spread by capillary action between the outer and inner ends 46, 48 of the vanes 34 and the respective first and second support apertures 50, 54 which upon solidification rigidly joins the vanes 34 to the outer and inner bands 36, 38 to form the nozzle segment **30*a***.

Figure 4:
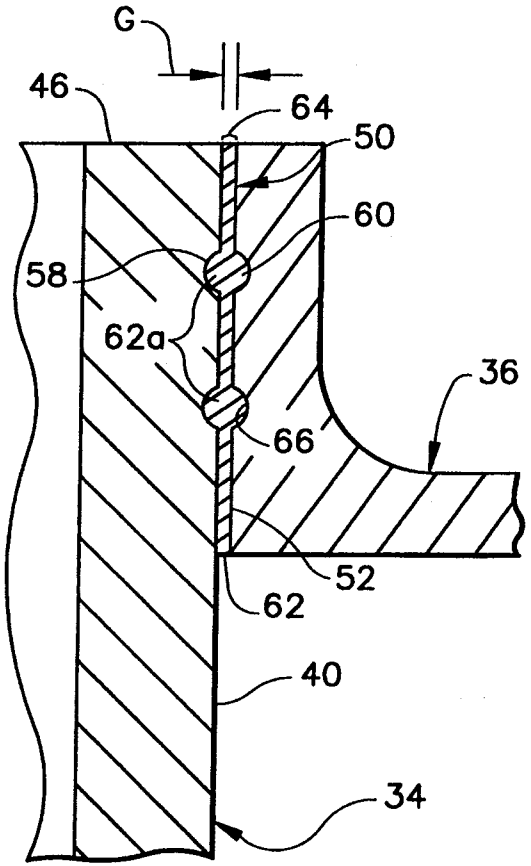
FIG. 4 is a transverse radial sectional view through the outer end of one of the vanes illustrated in FIG. 3 adjacent to the outer band and taken along line 4—4 to illustrate a braze joint in accordance with one embodiment of the present invention.

As illustrated in more particularity in FIG. 4, the vane first end 46 is conventionally spaced apart from the support aperture inner surface 52 to define a gap 64 therebetween. The gap 64 has a predetermined thickness G for receiving the brazing material 62 which fills the gap 64 upon solidification after brazing for bonding together the vane first end 46 to the inner surface 52 of the first support aperture 50. As shown in FIGS. 2 and 4, the band grooves 60 extend colinearly with and face the respective airfoil grooves 58 to collectively define therebetween respective enlarged interstitial crevices 66 as illustrated in FIG. 4 for receiving the brazing material 62 therein. The brazing material 62 is shown solidified in FIG. 4 after the brazing operation for bonding together the vane first end 46 in the support aperture 50 of the outer band 36, and filling the crevice 66 to form an enlarged reinforcing pin **62*a* therein, In the exemplary embodiment illustrated in FIG. 4, the airfoil groove 58 and the band groove 60 are generally semicircular in transverse section so that the crevice 66 is generally circular in transverse section, with the corresponding pin 62*a* being substantially circular in transverse section, In the embodiment illustrated in FIG. 4, a plurality of the airfoil grooves 58 and of the band grooves 60 are provided and disposed in radially spaced apart, or longitudinally spaced apart relative to the vane axis, pairs to define respective pluralities of the crevices 66 forming respective ones of the pins 62*a* therein. Alternatively, either a single crevice 66 and respective pin 62*a* may be formed or more than two crevices 66 and respective pins 62*a* may be formed as desired for suitably reinforcing the brazed joint between the vane outer end 46 and the outer band 36**.

Accordingly, the vane outer end 46 is fixedly joined to the outer band 36 through the first support aperture 50 by the brazing material 62 completely around the circumference thereof. The brazing material 62 forms the enlarged pins **62*a* in the respective crevices 66, which pins 62 also extend completely around the vane outer end 46 in this exemplary embodiment. The brazing material 62 is therefore intimately bonded to the vane outer surface 40 at its first end 46 and to the inner surface 52 of the first support aperture 50 for providing a brazed joint which is conventionally strong in shear. The reinforcing pins 62*a* provide additional strength to the brazed joint for accommodating the bending moment M illustrated in FIG. 1 due to the cantilever support of the nozzle 30 at its outer band 36**.

More specifically, in the event of any separation between the brazing material 62 and the corresponding surfaces of the vane 34 and outer band 36 during operation in the engine 10, the pins 62*a* will remain as mechanical structures preventing disassembly of the vane 34 from the outer band 36. The pins 62*a* will therefore act as shear pins preventing separation of the components. Suitable conventional brazing material 62 may be used to provide an acceptably strong shear-pin type joint. And, any suitable filler or brazing material having a melting temperature at or below that of the vane 34 and band 36 may be used as desired for providing varying degrees of strength in the joint.

Figure 5:
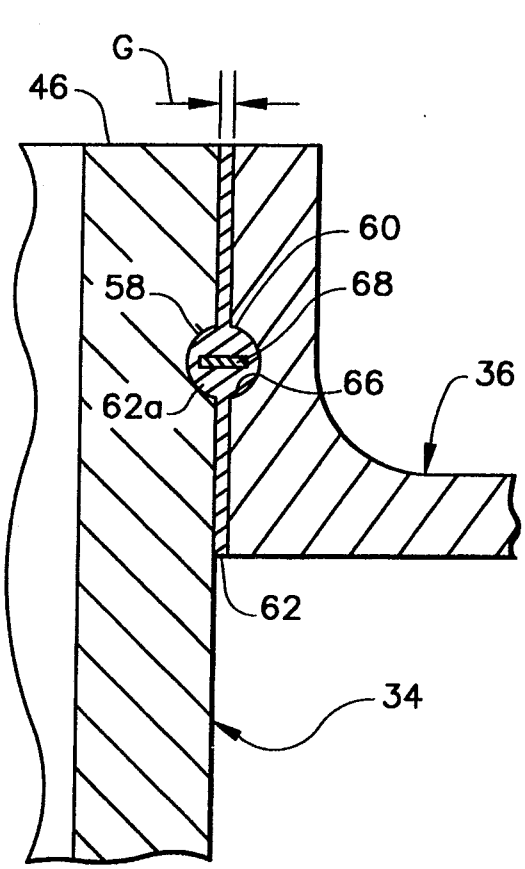
FIG. 5 is a transverse radial sectional view through the outer end of one of the vanes illustrated in FIG. 3 adjacent to the outer band and taken along line 4—4 to illustrate a braze joint in accordance with a second embodiment of the present invention.

For further increasing the strength of braze joint between the vane 34 and the outer band 36, for example when using lower strength brazing materials, an elongate reinforcing strip 68 as illustrated in FIG. 5 may be disposed in the crevice 66 and along the airfoil groove 58 and the band groove 60 and within the pin 62*a*. As shown in FIG. 5 the reinforcing strip 68 is rectangular in transverse section. As shown in the FIG. 6 embodiment of the invention, the reinforcing strip designated 68*a* is circular in transverse section. The reinforcing strip 68, 68*a* may take any suitable configuration for reinforcing the pin 62*a* and the joint formed by the brazing material 62.

Figure 6:
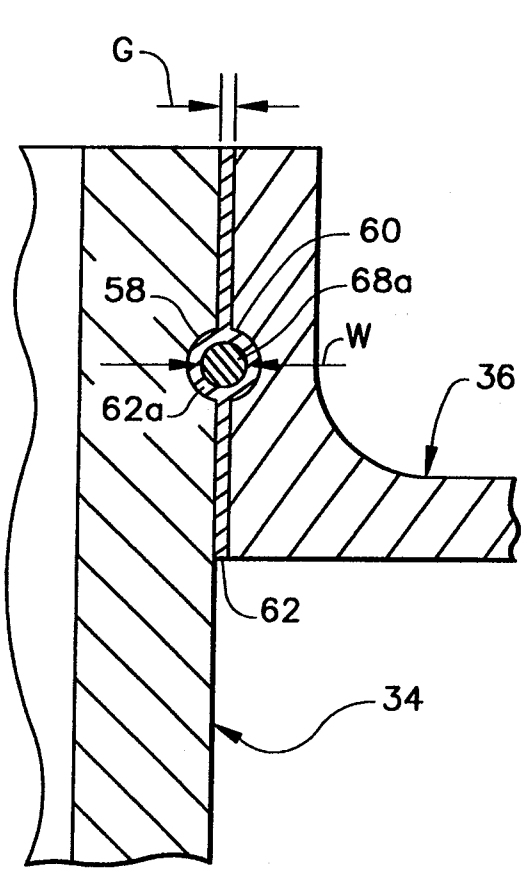
FIG. 6 is a transverse radial sectional view through the outer end of one of the vanes illustrated in FIG. 3 adjacent to the outer band and taken along line 4—4 to illustrate a braze joint in accordance with a third embodiment of the present invention.
Figure 7:
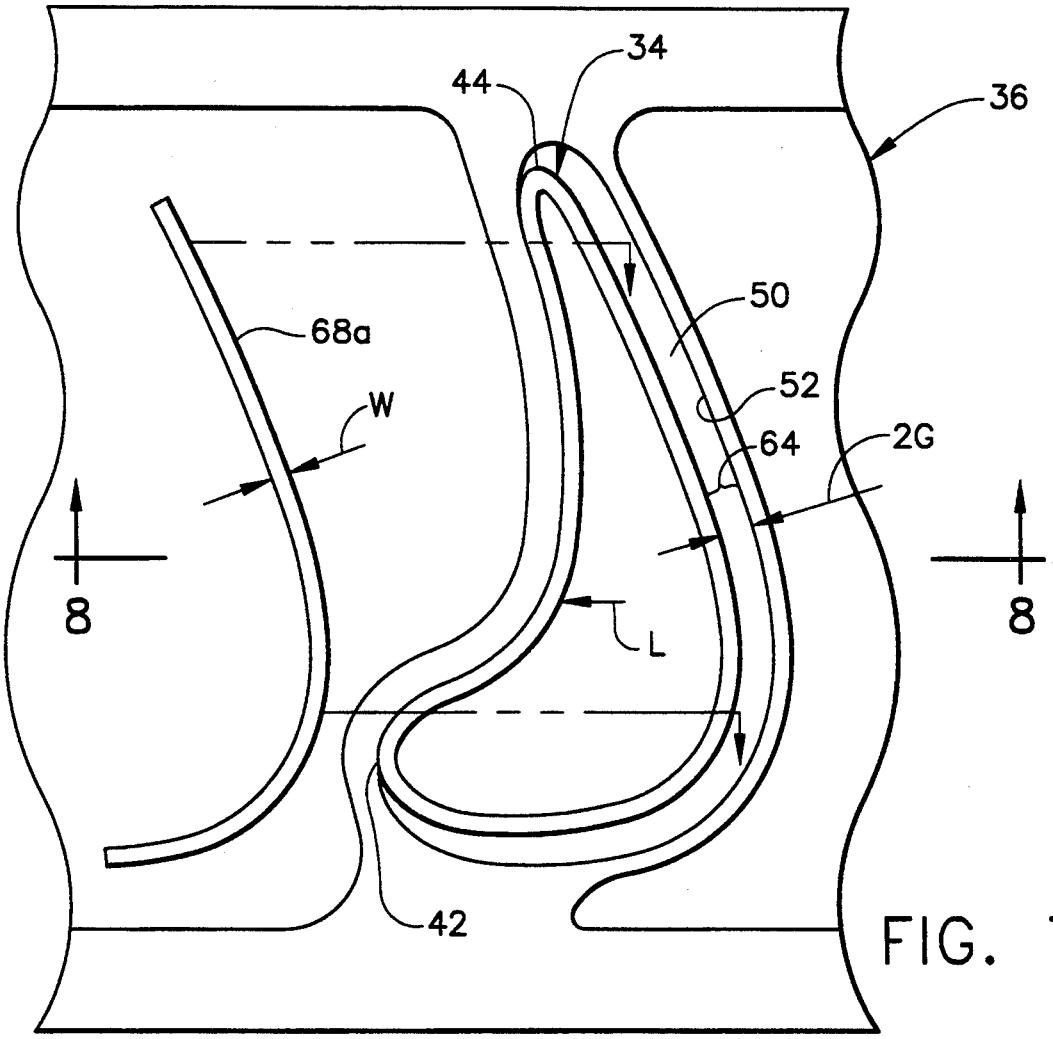
FIG. 7 is a top view of a portion of the outer band and one of the vanes thereof illustrated in FIG. 3 showing assembly of a first reinforcing strip therein.

FIGS. 7–10 illustrate an exemplary embodiment of the circular reinforcing strip 68*a* and its assembly between the vane 34 and the outer band 36. As shown in FIG. 7, the reinforcing strip 68*a* may have any suitable length and in the exemplary embodiment illustrated, it is configured for extending substantially between the vane leading edge 42 to the vane trailing edge 44 on the convex side thereof. As shown in FIG. 6 upon completion of the brazing process, the thickness of the braze 62 is nominally the gap thickness G which is preferably fairly uniform around the circumference of the vane 34 as is obtained in conventional practice and may be about 0.25 mm for example. The reinforcing strip 68*a* has a width W which is preferably greater than the gap thickness G. This is to ensure that the reinforcing strip 68*a* is as large as practical so that it is not readily removed during the assembly process and binds with the brazing material 62 substantially completely therearound to form the reinforcing pin 62*a*.

Figure 8:
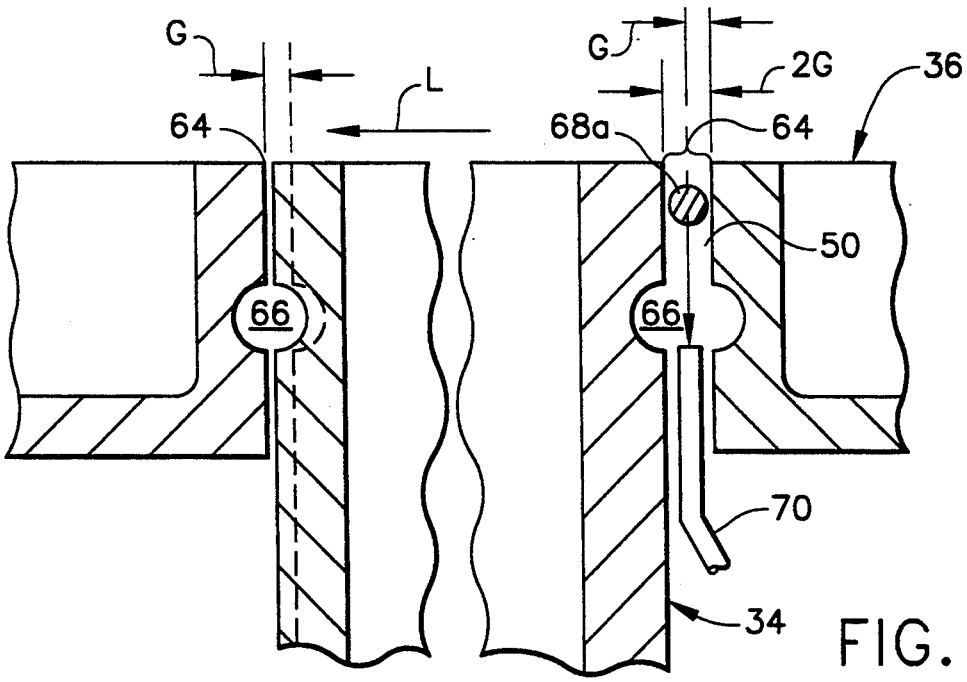
FIG. 8 is a radial sectional view of the outer end of the vane and outer band illustrated in FIG. 7 and taken along line 8—8.
Figure 9:
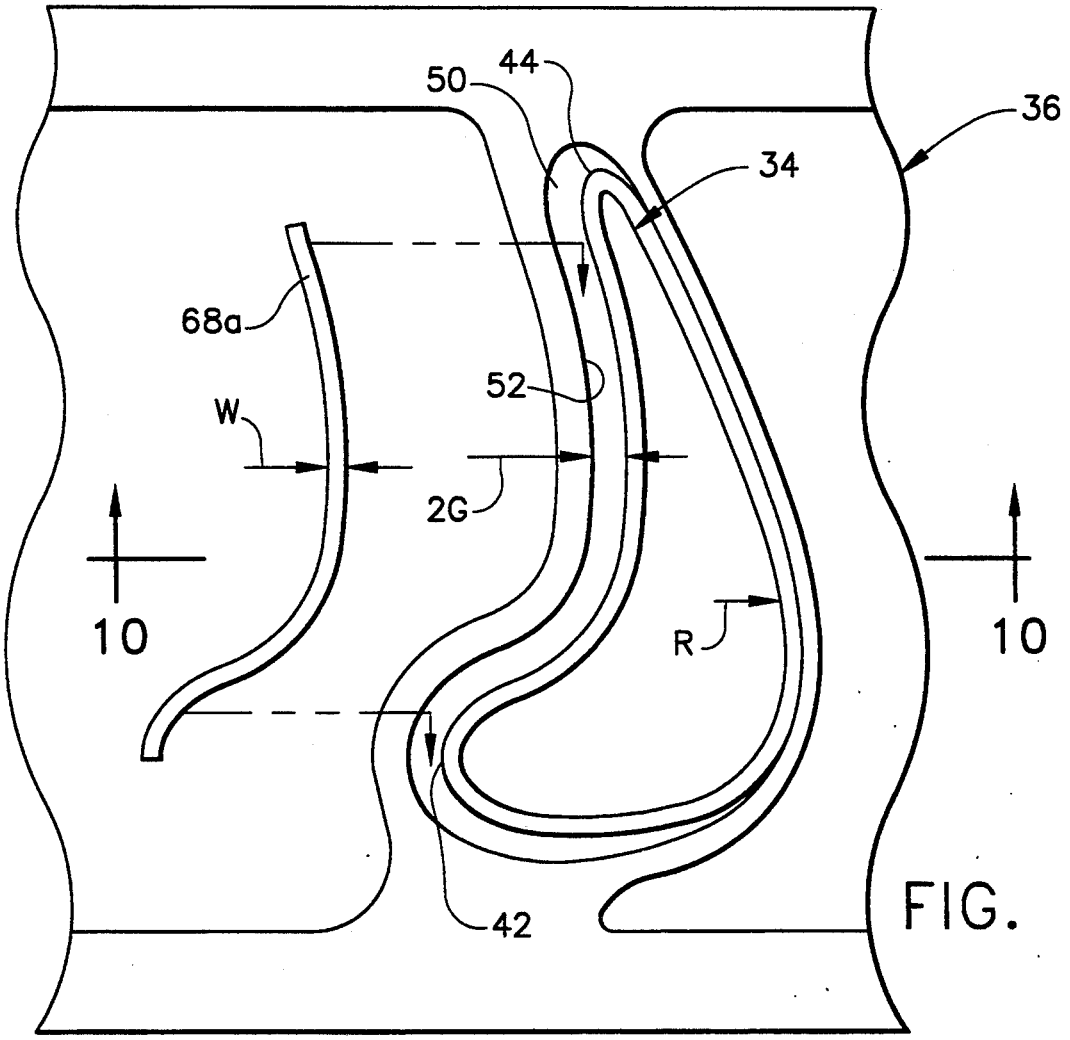
FIG. 9 is a top view similar to FIG. 7 illustrating the assembly of a second reinforcing strip between the vane and outer band.
Figure 10:
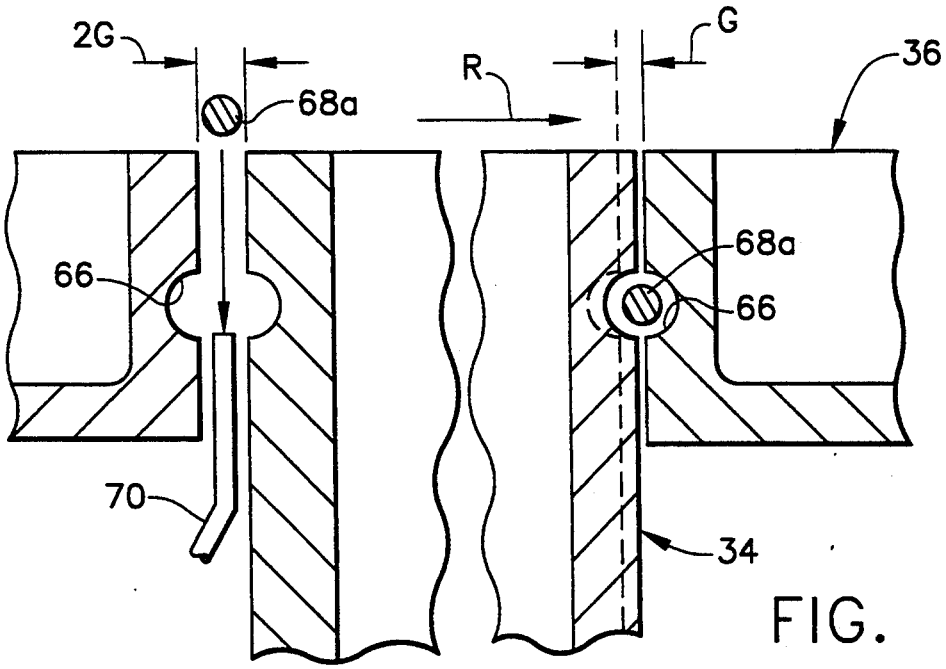
FIG. 10 is a radial sectional view of the outer end of the vane and outer band illustrated in FIG. 9 and taken along line 10—10.

In order to assemble the reinforcing strip 68*a* which is wider than the nominal gap thickness G, the vane 34 may be initially moved to the left as indicated by the arrow labeled L in FIGS. 7 and 8 so that the vane 34 touches the left side of the inner surface 52 of the first support aperture 50 and maximizes the gap at the right side of the vane 34 which has a magnitude of about 2G. The width W of the reinforcing strip 68*a* is suitably less than the maximum available gap thickness 2G so that it may be inserted downwardly into the gap 64 and into position within the crevice 66. A suitable temporary retention wire 70 may be inserted up to the crevice 66 from the bottom of the first support aperture 50 in order to temporarily hold the reinforcing strip 68*a* in position in the crevice 66 until the vane 34 is moved to the right as indicated by the arrow labeled R in FIGS. 9 and 10 as the retention wire 70 is removed. The reinforcing strip 68*a* on the right side of the vane 34 is then trapped in the crevice 66, and then a second one of the reinforcing strip 68*a* may be similarly inserted into the enlarged gap on the left side of the vane 34. The vane 34 may then be centered within the first support aperture 50 for obtaining the nominal gap G around its circumference and thusly trapping within the crevice 66 the two reinforcing strips 68*a* on both sides of the vane 34. The brazing material 62 is then conventionally applied to the gap 64 between the vane 34 and the outer band 36 and conventionally heated to flow by capillary action to completely fill the gap 64 around the circumference of the vane outer end 46, which after cooling forms a relatively rigid brazed joint.

The braze joint of the vane outer end 46 and the outer band 36 has improved strength due to the so-formed shear pin 62*a* either alone or with the reinforcing strip 68, 68*a* therein. This allows the vanes 34 themselves to be conventional high strength, single crystal components, integrally joined to the conventional, non-single crystal outer and inner bands 36, 38.

Since the inner band 38 as illustrated in FIG. 1 is unsupported and is not subject to the bending moment M, it may be conventionally brazed to the vane inner ends 48 as shown in FIG. 3 with the brazing material 62 filling the gap therebetween without the crevices 66 or reinforcing pin 62*a* formed therein. Of course, and if desired, the reinforcing pins 62*a* may also be formed between the vane inner end 48 and the inner band 38.

The reinforcing strips 68, 68*a* may be any conventional metal such as Hastalloy X or other conventionally known nickel-based alloys. The reinforcing strips 68, 68*a* provide a mechanical locking feature of the braze joint and due to metallurgical bonding or interdiffusion with the brazing material 62 also provide additional strengthening of the reinforcing pin 62*a*, as well as limits the volume of the weaker brazing material 62*a*.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is claimed and desired to be secured by Letters Patent of the United States is as defined and differentiated in the following claims:

1. A gas turbine engine stator vane comprising a hollow airfoil having an outer surface extending laterally between a leading edge and a trailing edge and longitudinally between first and second opposite ends, said outer surface adjacent said first end having at least one groove therein extending at least in part laterally between said leading and trailing edges for receiving a brazing material.

2. A stator vane according to claim 1 in combination with an arcuate first band, said first band having an inner surface defining a support aperture being complementary in configuration with said airfoil at said first end and receiving therein said first end, said support aperture inner surface having at least one groove therein extending colinearly with and facing said airfoil groove to collectively define therebetween an enlarged crevice for receiving said brazing material.

3. A combination according to claim 2 further including said brazing material bonding together said airfoil first end in said first band, and filling said crevice to form a reinforcing pin therein.

4. A combination according to claim 3 wherein said airfoil groove and said band groove are generally semicircular in transverse section so that said crevice is generally circular in transverse section.

5. A combination according to claim 4 further including an elongate reinforcing strip disposed in said crevice along said airfoil groove and said band groove, and within said pin.

6. A combination according to claim 5 wherein said airfoil first end is spaced from said support aperture inner surface to define a gap therebetween having a predetermined thickness, and said strip has a width greater than said gap thickness.

7. A combination according to claim 6 wherein said strip is rectangular in transverse section.

8. A combination according to claim 6 wherein said strip is circular in transverse section.

9. A combination according to claim 6 wherein said gap is filled with said brazing material bonding together said airfoil first end to said support aperture inner surface.

10. A combination according to claim 6 further comprising a plurality of said airfoil grooves and said band grooves disposed in longitudinally spaced apart pairs to define respective pluralities of said crevices forming respective ones of said pins therein.

11. A combination according to claim 6 further comprising an arcuate second band having an inner surface defining a second support aperture being complementary in configuration with said airfoil at said second end and receiving therein said second end, said airfoil second end being fixedly joined to said second band by brazing material to form a turbine nozzle segment.

* * * * *